US005970895A

United States Patent [19]

Mack

[11] Patent Number: 5,970,895

[45] Date of Patent: Oct. 26, 1999

[54] FLAT HOOPING DEVICE WITH BACKING CLAMP

[76] Inventor: Charles H. Mack, W152 N7406 Westwood Dr., Menomonee Falls, Wis. 53051

[ * ] Notice: This patent is subject to a terminal disclaimer.

[21] Appl. No.: 09/039,936

[22] Filed: Mar. 16, 1998

[51] Int. Cl.[6] ..... D05C 9/04

[52] U.S. Cl. ..... 112/103; 38/102.2

[58] Field of Search ..... 112/103, 78, 470.14, 112/475.18; 38/102, 102.2, 102.91; 160/38; 33/11, 172, 13

[56] References Cited

U.S. PATENT DOCUMENTS

| | | | |
|---|---|---|---|
| 1,797,889 | 3/1931 | Wiberg . | |
| 3,443,536 | 5/1969 | Rolauffs et al. . | |
| 3,664,288 | 5/1972 | Weidlin Von Boden et al. . | |
| 4,292,748 | 10/1981 | Miller . | |
| 4,466,601 | 8/1984 | Raines . | |
| 4,545,127 | 10/1985 | Barry . | |
| 4,561,177 | 12/1985 | Rancer . | |
| 4,620,687 | 11/1986 | Bishop . | |
| 4,644,629 | 2/1987 | Moore, III . | |
| 4,767,111 | 8/1988 | Guenther . | |
| 4,774,778 | 10/1988 | Williams . | |
| 4,837,913 | 6/1989 | Moore, III . | |
| 4,869,183 | 9/1989 | Moore, III | 112/103 |
| 5,144,899 | 9/1992 | Allen . | |
| 5,433,158 | 7/1995 | Moore, III . | |
| 5,546,877 | 8/1996 | Moore | 112/103 |
| 5,590,613 | 1/1997 | Head . | |
| 5,842,430 | 12/1998 | Mack | 112/103 |

OTHER PUBLICATIONS

Advertisement: Tubular Hoop Aligner Crafts by Ron, Inc.

Advertisement: Magnetic Holding System Magna–Frame.

*Primary Examiner*—Ismael Izaguirre

*Attorney, Agent, or Firm*—Ryan Kromholz & Manion, S.C.

[57] ABSTRACT

The flat hooping device for use with embroidery machines disclosed herein is comprised of a base plate having a recess sized to receive a female hoop member and a backing material locator for securing a piece of backing material over the female hoop member. The base plate may be used by itself or with a hooping rack. The hooping rack has a plurality of aligning holes formed in its surface that are arranged to receive aligning pins extending from the bottom of the base plate. The hooping rack also has a plurality of aligning indices and garment locating markings. The aligning indices indicate the position of the recess of the base plate when the base plate is mounted upon the hooping rack. The garment location indices indicate the position of a garment on the hooping rack.

10 Claims, 4 Drawing Sheets

FLAT HOOPING DEVICE WITH BACKING CLAMP

BACKGROUND OF THE INVENTION

The present invention relates generally to the field of embroidering and specifically to the use of a flat hooping device to ensure the proper location and alignment of an article of clothing in an embroidery machine.

Embroidery is an attractive and popular method of decorating articles of clothing. It is also an effective and much used method of advertising. The popularity of embroidery and the need to embroider large numbers of garments in a short length of time has spawned the invention of machines able to embroider a plurality of garments at one time.

In like manner to hand embroidery, hoops are used to secure a garment beneath the sewing heads of an embroidery machine. The instant invention is drawn to the use of what are called flat hoops. In the field of embroidery, the term flat refers to the configuration of the garment or other workpiece to be embroidered. Flat hoops are used with the relatively flat support members of garments such as the back or front of jackets, shirts, or the like. Flat hoops may be comprised of a larger and a smaller section of a hollow cylinder, though the hoops do not necessarily have to be circular. The larger hoop is called the female hoop member and is sized so as to frictionally receive in its inner diameter the smaller hoop, which is called the male hoop member. The hoops are used to secure and to stretch a piece of fabric or a portion of a garment that is to be embroidered. As is well known, the portion of the garment to be embroidered is placed between the male and female hoop members. Once the portion of the garment to be embroidered is properly framed by the hoop members, the male hoop member is seated within the female hoop member, thereby catching a portion of the garment to be embroidered between the inner diameter of the female hoop member and the outer diameter of the male hoop member. The garment is retained between the hoop members by the friction fit of the hoop members, the magnitude of the friction force being enhanced by the added thickness of the garment caught therebetween.

It is the practice of the embroidering industry to provide attachment means upon one of the hoop members so as to permit the hoop members and the garment secured therebetween, to be secured to the embroidery machine for the embroidery operation. With flat hoops the female hoop member is generally the hoop member that is provided with the attachment means. The attachment means on the female hoop member permit a ganged embroidery machine to embroider a number of garments at one time rather than a single garment.

However, problems exists in the use of flat hoops. Because the methods and devices heretofore used for positioning a garment between the male and female hoop members have not been sufficiently accurate or precise, the number of flawed garments turned out by embroidery machines has been high. Quite often a garment is improperly secured between the male and female hoop members, resulting in the embroidery being in the wrong position or in being misaligned or skewed. As embroidery is for all intents and purposes permanent, each flawed garment represents a loss to the manufacturer.

Another problem that exists in the process of using flat hoops in the embroidery process is the amount of time necessary to properly secure a garment between male and female hoop members. It is difficult and very time consuming to measure by hand the proper positioning and alignment for a hoop on a garment. What is more, when measuring by hand it is very easy to make a mistake. Placing the garment between the hoops by sight is much faster, but results in far more mistakes and incurred cost. The problem with many of the devices of the prior art is that they incorporate far too many steps that are carried out by hand measurement or by sight alone. Not only does using the hooping devices of the prior art require too much time, but there is also a higher risk of error.

In U.S. Pat. No. 5,842,430, assigned to the same assignee as the present application, these problems were addressed in the context of a tubular hooping device. The present invention utilizes a number of the principles of my previous invention but differs significantly from my previous invention in that flat hoops are not interchangeable with tubular hoops. Tubular hoops, because of the type of garment with which they are used, have attachment means affixed to, or incorporated therein, the male hoop members, whereas with flat hoops, the attachment means are associated with the female hoop members. The structure of my previous invention will not function with the flat hoops that are the object of my present invention.

It is therefore an object of this invention to provide a device that will permit a user to accurately locate a predetermined portion of a garment between a male hoop member and a female hoop member.

It is another object of this invention to provide a device that permits a user to precisely repeat the procedure of accurately locating a predetermined portion of a garment between a male hoop member and a female hoop member.

It is another object of this invention to provide a device that will retain a portion of backing material in a predetermined location so as to ensure that the backing material will be secured with the garment between the male and female hoop members.

It is yet another object of this invention to provide a device that will ensure that the male and female hoop members are mated so as to minimize the potential for the garment or hoop members to interfere with the sewing heads of an embroidery machine.

A final object of this invention is to provide a device and method for accurately and precisely aligning garments over a female hoop member so that a predetermined portion of the garment may be secured between the male and female hoop members for embroidering.

SUMMARY OF THE INVENTION

The present invention is directed to a flat hooping device that permits a user to quickly, accurately, and precisely secure a portion of a garment to be embroidered between a male hoop member and a female hoop member so that the garment can be mounted adjacent the sewing heads of an embroidery machine for embroidering. The flat hooping device described herein is comprised of a base plate having a recess formed therein. This recess is arranged to receive a female hoop member. A backing material locator is affixed to the base plate adjacent to the recess in the base plate. The base plate also has at least two aligning pins that extend normal to and from the bottom of the base plate.

The flat hooping device also comprises a hooping rack. The hooping rack has a relatively flat support member with a plurality of aligning holes formed therein. The aligning holes in the flat support member are arranged to receive the aligning pins of the base plate. The support member of the hooping rack has an upper edge that approximates the profile of a person's shoulders to aid in aligning garments upon the hooping rack. A plurality of aligning indices indicate the location of the recess in the base plate when the aligning pins of the base plate are received in the plurality of discrete sets of aligning holes. A plurality of garment location indices serve to indicate the location of a garment arranged upon the hooping rack.

The backing material locator is comprised of a bottom plate affixed to the base plate immediately adjacent the recess formed in the base plate and a top plate hinged to the bottom plate along a substantially linear first edge of each plate. The first edge of each plate is located away from the recess. Each of the top and the bottom plates has a second edge, the second edges are substantially identical to each other, and to a profile of the edge of the recess. The second edges of the top and bottom plates are also substantially collinear with the edge of the recess. The bottom plate and the top plate are preferably made of material permitting magnetic attraction to one another, so that a portion of backing material may be retained in frictional clamping relationship between the bottom plate and top plate when in magnetically attracted, closed position.

It will also be apparent that the present invention contemplates other means of retaining the top and bottom locator plates in closed position to frictionally retain the backing material therebetween. One such arrangement (not shown) may consist of a backing material locator including a bottom plate and top plate, not unlike the plates of the above-mentioned embodiment, but wherein the plates are biased into contact with one another by means of a coil spring or other known spring arrangement, as a means of frictionally retaining a portion of backing material therebetween.

The method of securing a predetermined portion of a garment that is to be embroidered between a male hoop member and a female hoop member comprises a number of steps. The first step is to mount a base plate of a flat hooping device upon a hooping rack in a predetermined location, with the predetermined location being identified by one of a plurality of aligning indices. A female hoop member is then placed in a recess formed in the base plate of the flat hooping device.

The top plate of the backing material locator that is affixed to the base plate adjacent to the recess is pivotally rotated on its hinge away from a bottom plate of the backing material locator to receive a piece of backing material. The backing material is placed over the female hoop member, and the top plate of the backing material locator is again rotated into contact with the backing material. Once the backing material is in its proper place and lying over the female hoop member, the garment to be embroidered is arranged upon the hooping rack in a predetermined location, with the predetermined location of the garment being identified by one of a plurality of garment locating indices. The male hoop member is then inserted into the female hoop member, to secure therebetween the portion of the garment to be embroidered along with the pre-located and secured backing material.

The present invention also comprises a method for quickly and accurately setting up the flat hooping device upon the hooping rack by means of a pair of alphanumeric characters. The first step of this method is to provide a first alphanumeric character that corresponds to a specific aligning index of the hooping rack, which indicates a specific location upon the hooping rack. Next, a second alphanumeric character that corresponds to a specific garment location index of the hooping rack is provided. The garment location index identified by the second alphanumeric character indicates a specific garment arrangement upon the hooping rack. The flat hooping device is then arranged upon the hooping rack in the specific location indicated by the first alphanumeric character. The aligning pins extending normally from the bottom surface of the flat hooping device are received in the aligning holes of the hooping rack in the specific location indicated by the first alphanumeric character. Finally, a garment to be embroidered is arranged upon the hooping rack in the specific garment arrangement indicated by the second alphanumeric character.

DETAILED DESCRIPTION

Figure 1:
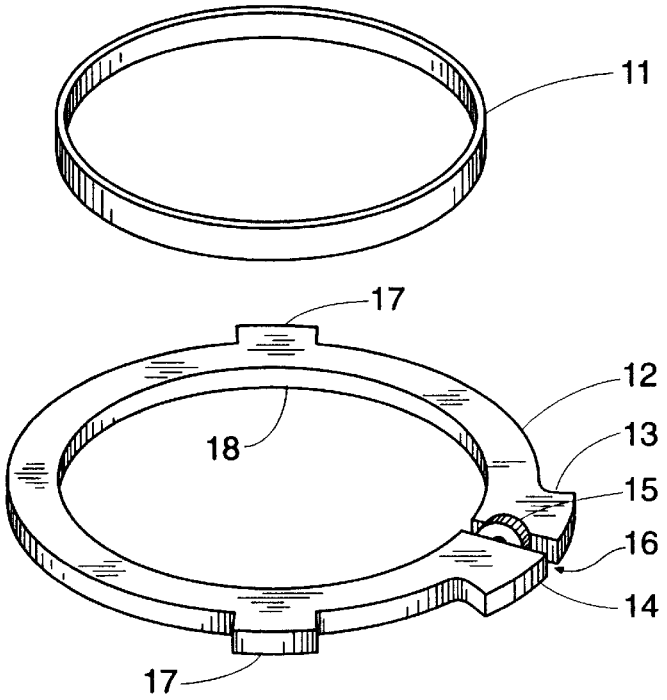
FIG. 1 is an exploded perspective view of the male and female hoop members.

Although the disclosure hereof is detailed and exact to enable those skilled in the art to practice the invention, the physical embodiments herein disclosed merely exemplify the invention which may be embodied in other specific structure. While the preferred embodiment has been described, the details may be changed without departing from the invention, which is defined by the claims.

The flat hooping device 10 of the present invention is comprised of a base plate 20 (See FIG. 2) having an upper recess 21 and a lower recess 22 formed therein. The hooping device 10 is further comprised of a backing material locator 30 mounted on the base plate 20 adjacent the upper recess 21. The hooping device 10 is also arranged to be adjustably mounted upon a hooping rack 40, which will hereinafter be described in connection with FIG. 3.

FIG. 1 illustrates a common variety of male and female hoop members, 11 and 12 respectively, that make up a flat hoop. As can be seen from the figure, this type of male hoop member 11 approximates a circular ring with an inner diameter and an outer diameter that are comparable in magnitude, and in this instance, fixed. The female hoop member 12 approximates a complementary ring shape. However, the female hoop member 12 also includes attachment means and adjusting means. It is also important to point out that the male and female hoop members 11 and 12 may be rectangular, trapezoidal, triangular, or any other useful shape.

Attachment means permit the female hoop member 12 to secure a garment beneath the sewing heads of an embroidery machine. In the present embodiment, the attachment means comprise diametrically opposed, essentially rectangular, projections 17 that project laterally outwardly of the outer diameter of the female hoop member 12. The projections 17 function as a point of mechanical attachment to an embroidery machine (not shown). Alternatively, the projections 17 may contain pin sockets (not shown) or other conventional mounting arrangements. It is important to point out that the exact geometry of the projections 17 may vary depending on the manufacturer of the hoop members and of the embroidery machines. Further, it should be pointed out that the attachment means might instead be incorporated into the body of the female hoop member 12 itself, obviating the need for projections 17.

Since thicknesses of the material to be embroidered may vary widely, it is important to be able to adjust the diameter of the female hoop member 12 to accommodate the material frictionally retained between the hoop members 11 and 12. Adjusting means for accomplishing this function comprises a thumbwheel 15 mounted upon a threaded rod (not shown) that connects with facing threaded re-entrant openings (not shown) in adjusting tabbed portions 13 and 14 of the female hoop member 12. By rotating the thumbwheel 15, the diameter of the female hoop member 12 can be readily adjusted. The adjusting means is well known in the industry.

Figure 2:
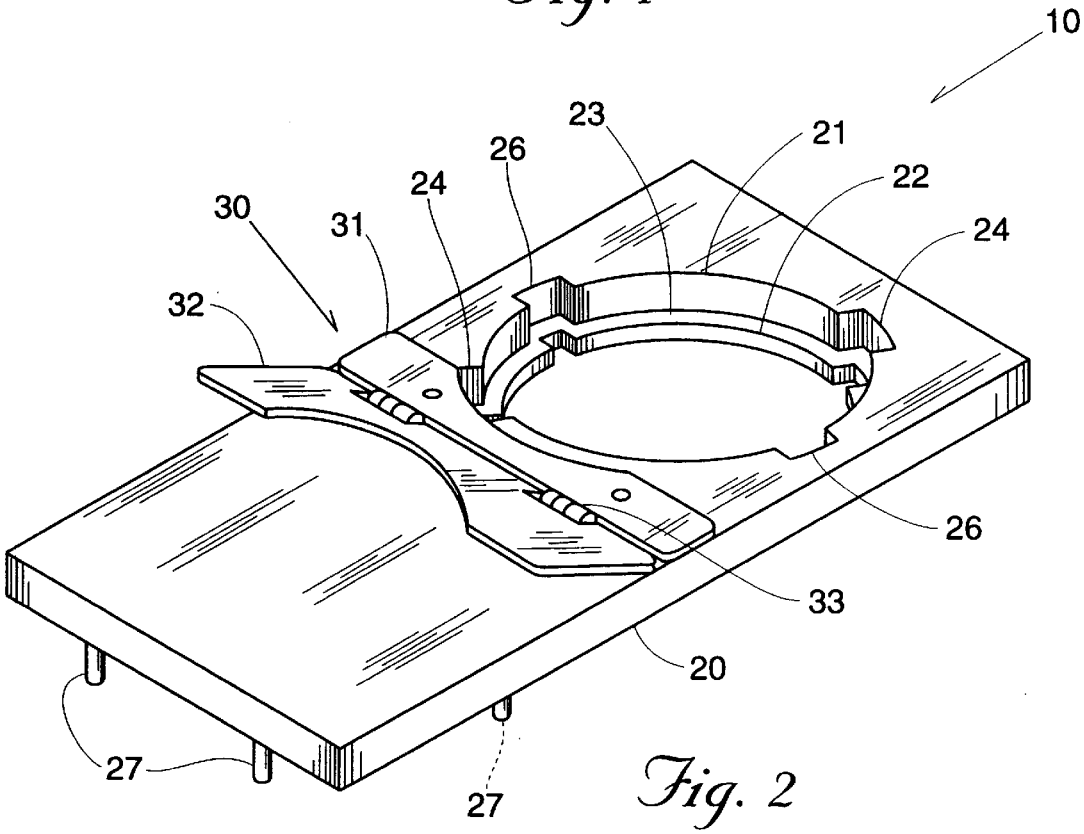
FIG. 2 is a perspective view of the flat hooping device.
Figure 3:
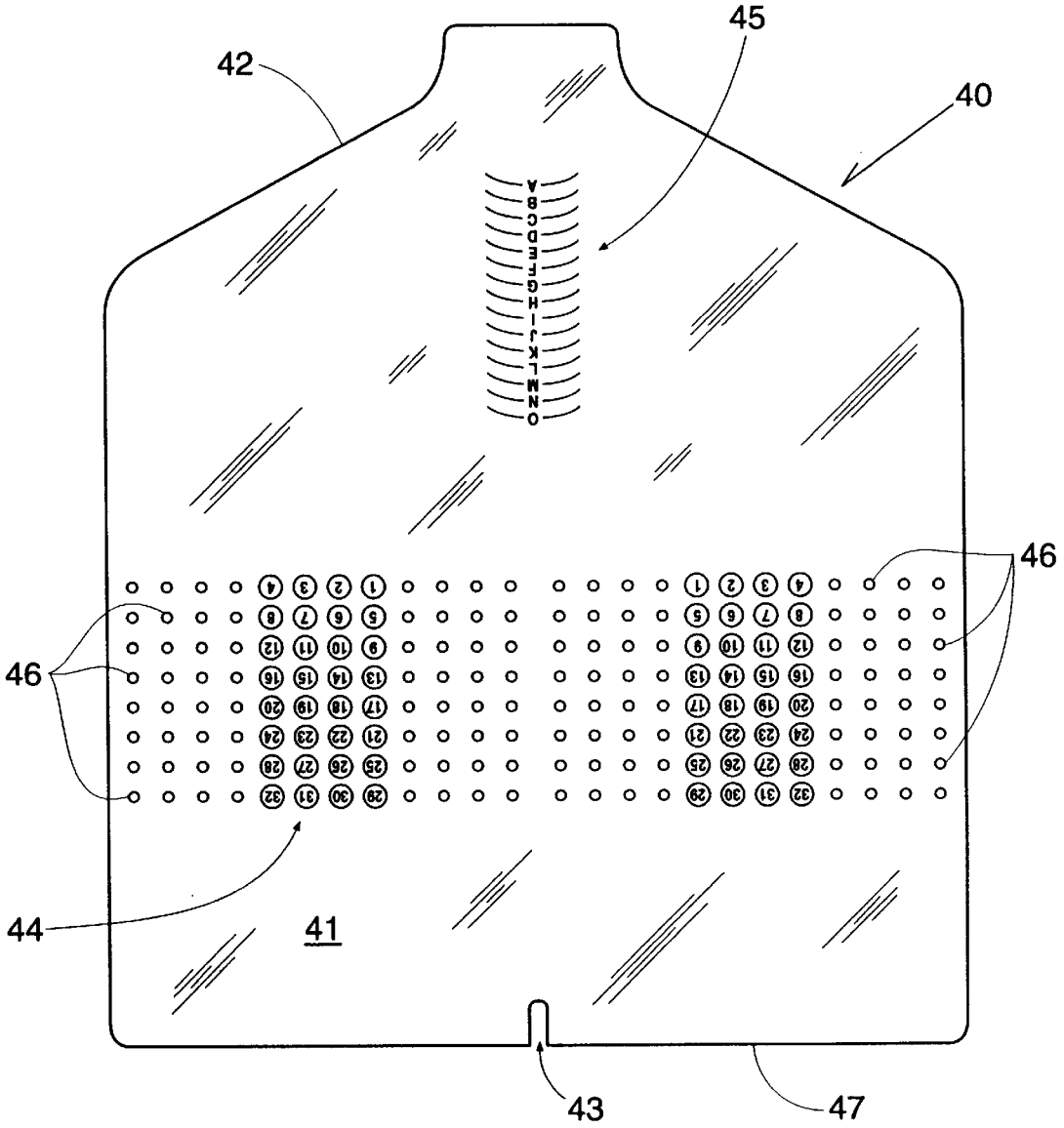
FIG. 3 is a plan view of the hooping rack.

Referring to FIG. 2, and as stated previously, the base plate 20 of the flat hooping device 10 includes an upper recess 21, and a lower recess 22 formed inwardly and depending from a shoulder or floor 23. The upper and lower recesses 12,14 each define registering notched indents 24 and 26. The notched indents 24, 26 are respectively arranged to receive the projections 17 and the adjusting tabs 13 and 14 of the female hoop member 12. The upper recess 21 is arranged to receive female hoop member 12 therein, and has essentially the same shape as the female hoop member 12; in this case, circular. It is to be understood that any useful number of notches 16 and 18 may be provided in recess 12 without exceeding the scope of the present invention.

The lower recess 22 is diametrically smaller than the upper recess 21 so that the female hoop member will be supported above the lower recess 22 upon shoulder 23. However, the inner diameter of the lower recess 22 is larger than the outer diameter of the male hoop member 11. This arrangement permits the male hoop member 11 to be inserted into and beyond the female hoop member 12. In some instances, it is necessary and preferable to seat the male hoop member 11 beyond the lower edge of the female hoop member 12. Conversely, in some instances, it may be counterproductive to seat the male hoop member 11 beyond the female hoop member 12. Therefore, where it is so desired, or where the circumstances dictate that there is no need for it, the lower recess 22 may be omitted without affecting the utility of the present invention.

When embroidering garments it is not desirable to embroider a single thickness of fabric. Rather, it is industry practice to place a piece of backing material (not shown) behind the particular portion of a garment that is to be embroidered. The backing material serves to strengthen the fabric being embroidered. In order to ensure that the backing material is located behind a particular portion of a garment to be embroidered, at least one backing material locator 30 is provided on the base plate 20. The locator 30 is preferably positioned immediately adjacent the upper recess 21. In the present embodiment the backing material locator 30 comprises a magnetic bottom plate 31 hinged at 33 to a magnetic top plate 32. It is to be understood that only one of the bottom or top plates 31 and 32 need be made of magnetized material, so long as the magnetic force generated between plates 31 and 32 is sufficient to maintain the backing material in its desired position. The hinge 33 can be of any useful type, such as a piano hinge or a fabric hinge made of an adhesive fabric tape, so long as it is are capable of permitting the top plate 32 to be pivotally rotated into and out of contact with the bottom plate 31. The bottom and top plates 31 and 32 have substantially identical profiles conforming to the contour of the upper recess 21. The backing material locator 30 is arranged to be frictionally retained between closed plates 31 and 32.

In normal operation, a female hoop member 12 is placed in the upper recess 21. The top plate 32 of the backing material locator 30 is rotated away from the bottom plate 31 to accommodate a single sheet of backing material. (not shown). The backing material is placed over a female hoop member 12 that is received by the upper recess 21 such that a portion of the backing material lies over the bottom plate 31. The top plate 32 of the backing material locator 30 is then rotated into contact with the backing material. The magnetic attraction between the top and bottom plates 31 and 32 acts to frictionally clamp the backing material into this position above the female hoop member 12. The backing material will then be secured along with the portion of the garment to be embroidered between the female and male hoop members 11 and 12 when the female hoop member 12 receives the male hoop member 11.

Figure 5:
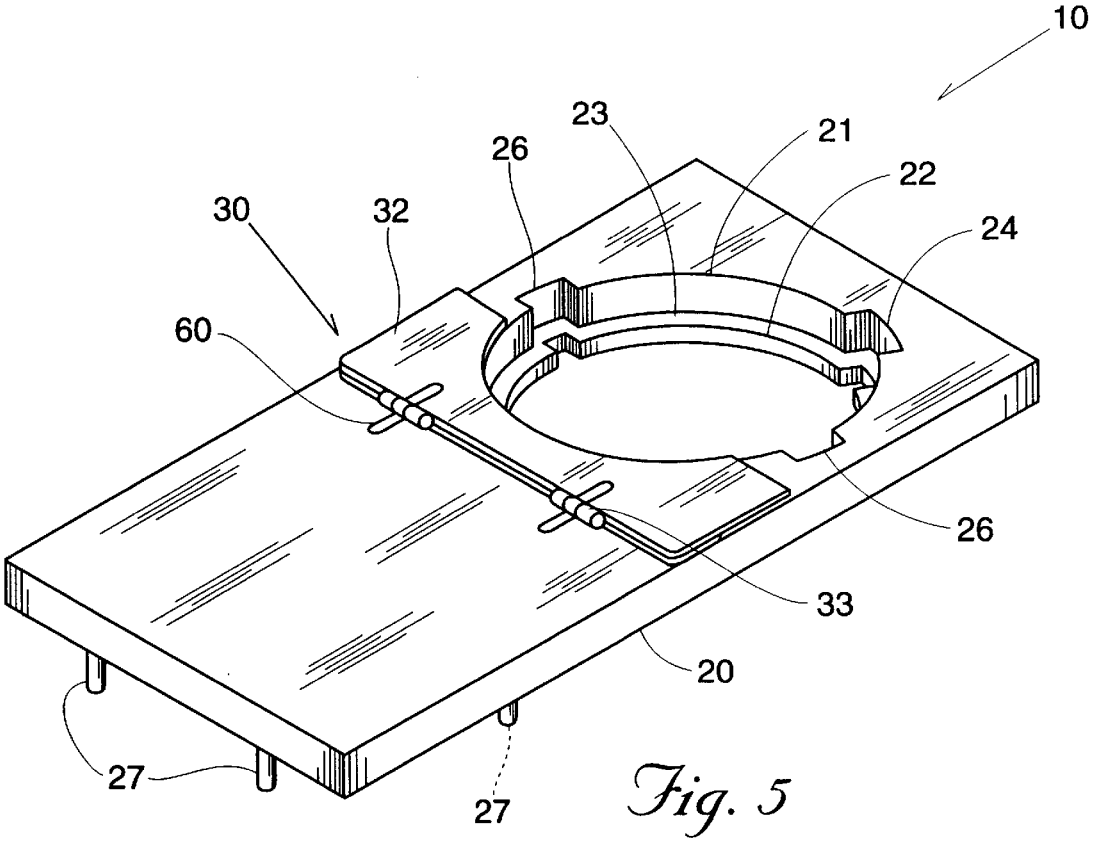
FIG. 5 is a perspective view of an alternative embodiment of the flat hooping device.

As previously stated, it is to be understood that the frictional forces imposed upon the backing material by the top and bottom plates 31 and 32 could be derived from a spring biasing means 60 coupled between the top and bottom plates 31 and 32, and remain within the scope of this invention (seen generally in FIG. 5).

Figure 4:
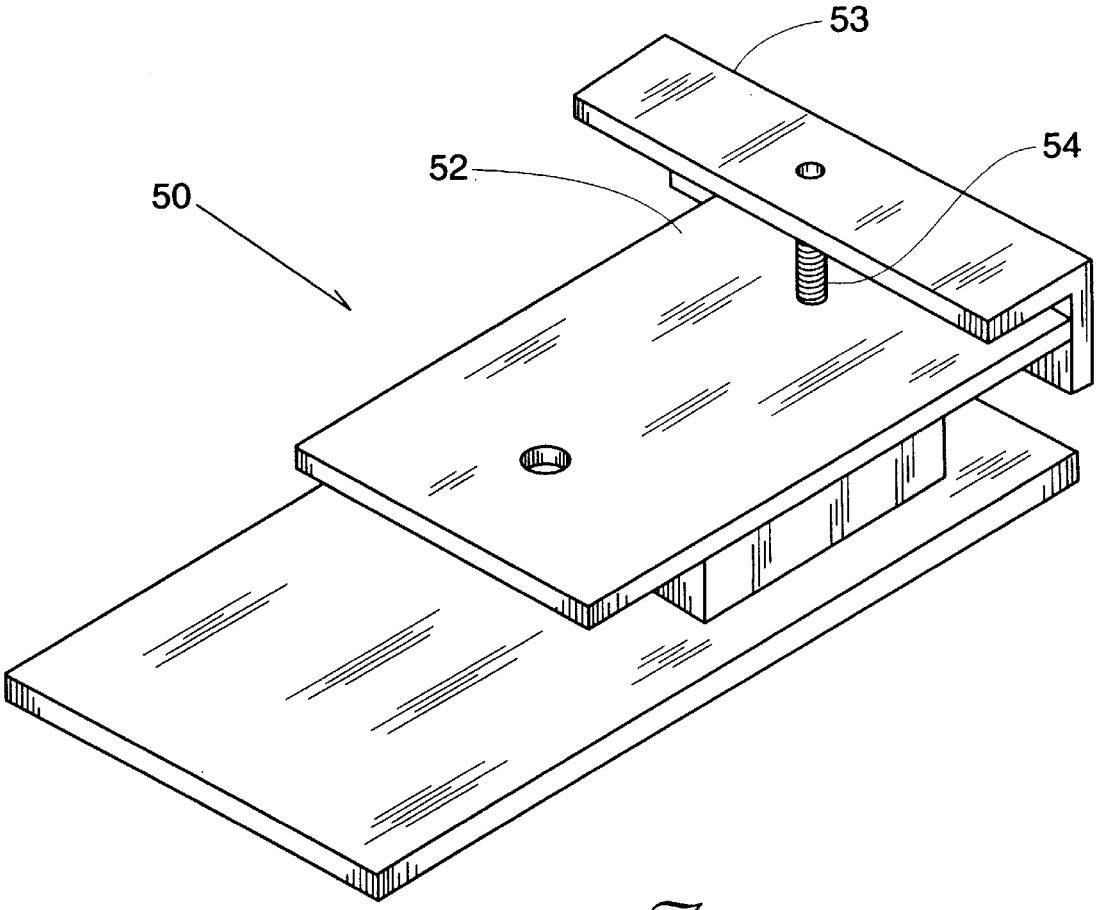
FIG. 4 is a perspective view of a typical hooping rack stand.

The flat hooping device 10 may be used by itself or may be mounted upon a stand 50 of the general type illustrated in FIG. 4. Though the flat hooping device 10 may be used in a stand-alone fashion, it is preferred to use the device 10 with a hooping rack 40, such as that illustrated in FIG. 3. It is also preferred that the hooping rack 40 be supported cantilever-fashion upon the stand 50. To mount the hooping rack 40 to the stand 50, the base edge 47 of the hooping rack 40 is inserted into the slot 52 formed by the angle iron 53 such that the pin 54 is engaged by slot 43.

The hooping rack 40 comprises a relatively flat support member 41 having an upper edge 42 that approximates the shape of a person's shoulders mounted to the top thereof. The upper edge 42 is one means for aligning a garment upon the hooping rack 40. The aligning holes 46 are sized and arranged so as to receive at least two aligning pins 27 that extend normally from the bottom of the base plate 20. (See FIG. 2). Inscribed on the face of the support member 41 are aligning indices 44 and garment location indices 45. Each aligning hole index 46 corresponds to a particular location upon the support member 41 that is defined by a corresponding set of aligning holes 46 that mate with the aligning pins 27 of the base plate 20. The aligning indices 44 permit the flat hooping device 10 to be quickly and accurately mounted upon the hooping rack 40 in any of the plurality of locations defined by the aligning holes 46. The garment location indices 45 permit a garment such as a shirt or a jacket to be accurately and precisely located upon the hooping rack 40. The shirt or jacket is simply pulled onto the hooping rack 40 to bring the neckline of the shirt or jacket into alignment with a predetermined garment location index 45. Using the aligning indices 44 in conjunction with the garment location indices 45 gives a simple, alphanumeric system for designating the portion of a garment that has been embroidered. For example, an alphanumeric of A1 indicates that the base plate 20 is to be mounted upon the hooping rack 40 at the aligning index labeled as "1" and that the garment to be embroidered is to be aligned using garment location index labeled as "A".

A portion of a garment that is to be embroidered is preferably hooped using the flat hooping device 10 in the following manner: The base plate 20 of the flat hooping device 10 is mounted upon the hooping rack 40 in a predetermined position. A female hoop member 12 is inserted into the upper recess and the top plate 32 of the backing material locator 30 is rotated away from the bottom plate 31. A piece of backing material is placed over the female hoop member 12 and the top plate 31 is rotated back into contact with the backing material, thereby securing the backing material in place. The garment to be embroidered is placed upon the hooping rack 40 and the portion of the garment that is to be embroidered is then arranged over the female hoop member 12 in a predetermined position using the garment location indices 45. Once the garment is in its desired location over the female hoop member 12, the male hoop member 11 is inserted into the female hoop member 12, thereby securing the garment to be embroidered between the inner diameter of the female hoop member 12 and the outer diameter of the male hoop member 11. Depending upon the thickness of the garment, it may be necessary to adjust the diameter of the female hoop member 12 using the adjusting thumbwheel 15 to maintain a suitable friction fit between the male and female hoop members 11 and 12. Where it is desired, and where the base plate 20 has been provided with a lower recess 22, the male hoop member 11 will be forced through female hoop member 12 so that the lower edge of the male hoop member 11 extends below the lower edge of the female hoop member 12. Once the garment has been appropriately secured between the male and female hoop members 11 and 12, the garment is removed from the hooping rack 40 and secured beneath the sewing head of an embroidery machine by the attachment means of the female hoop member 12 (not shown).

The foregoing is considered as illustrative only of the principles of the invention. Furthermore, since numerous modifications and changes will readily occur to those skilled in the art, it is not desired to limit the invention to the exact construction and operation shown and described. While the preferred embodiment has been described, the details may be changed without departing from the invention, which is defined by the claims.

What is claimed is:

1. A flat hooping device for accurately and precisely hooping portions of garments to be embroidered between a male hoop member and a mating female hoop member, the flat hooping device comprising a base plate having a recess arranged to receive said female hoop member and a backing material locator affixed to the base plate adjacent to the recess.

2. The flat hooping device of claim 1, wherein the base plate further comprises at least two aligning pins extending normally from the bottom of the base plate.

3. The flat hooping device of claim 2 further comprising a hooping rack, the hooping rack itself comprising:

a relatively flat support member having an upper edge that approximates the profile of a person's shoulders and including a plurality of aligning holes formed therein, said aligning holes being arranged to receive the aligning pins of the base plate;

a plurality of aligning indices, each of the aligning indices indicating the location of the recess in the base plate when the aligning pins of the base plate are received in a plurality of discrete sets of aligning holes; and a plurality of garment location indices, the garment location indices indicating the location of a garment arranged upon the hooping rack.

4. The flat hooping device of claim 1 wherein the backing material locator comprises:

a bottom plate affixed to the base plate immediately adjacent the recess formed in the base plate;

a top plate hinged to the bottom plate along a substantially linear first edge of each plate, the first edge of each plate being located away from the recess;

each plate further having a second edge, the profiles of the second edges of each plate being substantially identical to each other and to a profile of the edge of said recess; and biasing means interacting with said plates to bias said hinged plates towards one another, wherein a portion of backing material may be retained between said plates by a frictional force exerted on the backing material when retained between the plates when said plates are in biased-closed position.

5. The flat hooping device of claim 4, wherein said biasing means comprises magnetically attracted bottom and top plates, and wherein a portion of backing material may be retained between the bottom plate and the top plate by a frictional force exerted on the backing material when retained between the plates when said plates are in closed magnetically attracted position.

6. The flat hooping device of claim 1, wherein the backing material locator comprises:

a bottom plate affixed to the base plate immediately adjacent the recess formed in the base plate;

a top plate hinged to the bottom plate along a substantially linear first edge of each plate, the first edge of each plate being located away from the recess;

each plate further having a second edge, the profiles of the second edges of each plate being substantially identical to each other and to a profile of the edge of said recess, and the bottom plate and the top plate being magnetically attracted to one another, wherein a portion of backing material may be retained between the bottom plate and the top plate by a frictional force exerted on the backing material when retained between the plates when in closed magnetically attracted position.

7. The flat hooping device of claim 1 further comprising a backing material locator, the backing material locator being comprised of:

a bottom plate affixed to the base plate immediately adjacent the recess;

a top plate hinged to the bottom plate along a substantially linear first edge of each plate, the first edge of each plate being located away from the recess;

each plate further having a second edge, the profiles of the second edges of each plate being substantially identical to each other and to a profile of the edge of the recess, the second edges of the top and the bottom plates being substantially collinear with the edge of the recess, and;

the bottom plate and the top plate being biased into contact with one another by a spring means coupled between the bottom plate and the top plate such that a portion of backing material may be retained between the bottom plate and the top plate by friction forces created by the spring means holding the top plate to the bottom plate.

8. A method of securing a predetermined portion of a garment to be embroidered between a male hoop member and a female hoop member using a flat hooping device with a hooping rack, the flat hooping device comprising a base plate having a recess arranged to receive said female hoop member and a backing material locator affixed to the base plate adjacent to the recess, said backing material locator comprising a bottom plate pivotally hinged to a top plate, said hooping rack comprising a relatively flat support member having a plurality of aligning holes formed therein and an upper edge that approximates the profile of a person's shoulders, said support member further having a plurality of aligning indices and a plurality of garment location indices, the method comprising the steps of:

mounting said base plate of said flat hooping device upon said hooping rack in a predetermined location, the predetermined location being identified by one of a plurality of aligning indices;

placing a female hoop member in said recess formed in said base plate of said flat hooping device;

rotating said top plate of said backing material locator affixed to said base plate adjacent to said recess pivotally away from said bottom plate of said backing material locator;

placing a piece of backing material over said female hoop member received in said recess;

rotating pivotally said top plate of said backing material locator into contact with said backing material so as to retain said backing material over said female hoop member;

arranging said garment upon said hooping rack in a predetermined location, said predetermined location of said garment being identified by one of a plurality of said garment locating indices;

inserting said male hoop member into said female hoop member, securing therebetween said portion of said garment with said backing material; and removing said male and female hoop members from said flat hooping device and securing said female hoop member to an embroidery machine.

9. A device for accurately and precisely hooping portions of garments to be embroidered, the device comprising:

a base plate having a recess arranged to receive a female hoop member;

a backing material locator affixed to the base plate adjacent to the recess;

at least two aligning pins, the aligning pins being affixed to and extending normally from, the bottom of the base plate;

a hooping rack, the hooping rack comprising a flat member coupled to a garment locating means;

a plurality of aligning holes formed into the flat support member of the hooping rack, the aligning holes being arranged to receive the aligning pins of the base plate;

a plurality of aligning hole markings, the plurality of aligning indices being inscribed into the flat support member of the hooping rack, the aligning indices indicating the location of the recess in the base plate when the aligning pins of the base plate are received in a plurality of discrete sets of aligning holes; and a plurality of garment location markings, the garment location markings being inscribed in the surface of the flat support member of the hooping rack and indicating the location of a garment arranged upon the hooping rack.

10. A method for arranging a flat hooping device comprising a base plate having at least two aligning pins extending normally away from the bottom surface of the base plate, a recess arranged to receive said female hoop member, and a backing material locator affixed to the base plate adjacent to the recess, said backing material locator comprising a bottom plate pivotally hinged to a top plate, upon a hooping rack comprising a relatively flat support member having a plurality of aligning holes formed therein and an upper edge that approximates the profile of a person's shoulders, said support member further having a plurality of aligning indices and a plurality of garment location indices, the method comprising the steps of:

providing a first alphanumeric character that corresponds to specific aligning index of the hooping rack, the aligning index in turn indicating a specific location upon the hooping rack;

providing a second alphanumeric character that corresponds to a specific garment location index of the hooping rack, the garment location index in turn indicating a specific garment arrangement upon the hooping rack;

arranging upon the hooping rack in the specific location indicated by the first alphanumeric character, the flat hooping device, the aligning pins extending normally from the bottom surface thereof being received in the aligning holes of the hooping rack in the specific location; and arranging upon the hooping rack in the specific garment arrangement indicated by the second alphanumeric character, a garment to be embroidered.

* * * * *